US006993883B2

(12) United States Patent
Belanger

(10) Patent No.: US 6,993,883 B2
(45) Date of Patent: Feb. 7, 2006

(54) COMPOSITE BUILDING STUD

(76) Inventor: Ghislain Belanger, 8387, rue Rejane, Lasalle SBC (CA) H8N 2C3

( * ) Notice: Subject to any disclaimer, the term of this patent is extended or adjusted under 35 U.S.C. 154(b) by 0 days.

(21) Appl. No.: 10/438,006

(22) Filed: May 15, 2003

(65) Prior Publication Data

US 2003/0213209 A1 Nov. 20, 2003

Related U.S. Application Data

(63) Continuation-in-part of application No. 10/144,711, filed on May 15, 2002, now abandoned.

(51) Int. Cl.
*E06B 3/00* (2006.01)

(52) U.S. Cl. ..... 52/737.3; 52/736.3; 52/737.4; 52/730.1

(58) Field of Classification Search ..... 52/737.3, 52/737.4, 733.2, 730.1, 731.5, 731.9, 481.1, 52/736.3, 731.7
See application file for complete search history.

(56) References Cited

U.S. PATENT DOCUMENTS 3,528,636 A 9/1970 Schmidt
4,466,225 A 8/1984 Hovind
4,971,280 A 11/1990 Rinderer
5,072,547 A 12/1991 DiFazio
5,452,556 A 9/1995 Taylor
5,590,505 A 1/1997 Bogle
5,609,006 A 3/1997 Boyer
5,613,339 A * 3/1997 Pollock ..... 52/731.1
5,713,176 A 2/1998 Hunt
6,250,042 B1 6/2001 Rudd
6,488,257 B2 * 12/2002 McSwain ..... 249/219.2

* cited by examiner

*Primary Examiner*—Basil Katcheves
(74) *Attorney, Agent, or Firm*—Protections Equinox Int'l; Franz Bonsang

(57) ABSTRACT

A composite building stud for providing combined advantages of wood and metal studs. The composite stud includes a generally elongated and U-shaped frame member defining a base channel. The composite stud also includes a core component made of wood retainable in the base channel. The substantially rectangular configuration core component includes an insertion recess section forming a fifth wall thereof to allow insertion of the core component in the base channel both by sliding the core component longitudinally from an end section of the frame member and by a snap-like movement or action at an angle relative to the longitudinal axis of the frame member.

28 Claims, 8 Drawing Sheets

COMPOSITE BUILDING STUD

CROSS-REFERENCE TO RELATED APPLICATION

The present application is a Continuation-In-Part (C.I.P.) application of patent application Ser. No. 10/144,711 filed on May 15, 2002, now abandoned.

FIELD OF THE INVENTION

The present invention relates to the general field of building materials and is particularly concerned with a composite building stud.

BACKGROUND OF THE INVENTION

There exists a plurality of situations wherein it is desirable to assemble construction beams together. For example, conventional residential walls are typically erected using a framework including generally horizontal beams commonly referred to as plates assembled to generally vertical beams commonly referred to as studs. Wall panels are secured to the plates and/or studs.

The conventional plates and studs forming the skeletal portions of small buildings are typically made out of wood beams. Typically, these wood beams have a generally rectangular cross-sectional configuration and are typically dimensioned as being two inches by four inches. Wood plates and studs have been traditionally favored since they typically provide adequate structural support while being generally easy to assemble using a so called "toe nailing" approach.

Typically, the wood studs and wood plates are laid out on a supporting surface in a suitable configuration. The plates and studs are then fastened together by driving nails through the top and/or the bottom plate into the block end of the studs. In other words, the nails are driven through the outwardly facing surfaces of the plates and then through the top and bottom end of each stud.

Wood is also favored because of its thermal and noise insulation properties. Furthermore, wood is particularly convenient in situations wherein components such as electrical fixtures need to be anchored to the framework of the building. In such instances, the casing of the components such as electrical fixtures or the like merely needs to be attached to the wood beams using conventional fastening components such as screws, nails and the like.

Although wood beams provide numerous advantages, they nevertheless suffer from some drawbacks. Indeed, in view of the depletion of forest resources, lumber derived from old growth timber has become relatively scarce. Consequently, there has been, at least in some areas, a lack of supply and associated increased purchasing costs. Furthermore, the relatively younger timber that has been used as a replacement sometimes demonstrates poor dimensional stability and tensile strength. Hence, studs derived from younger timber may tend to warp and may have diminished load bearing ability. Also, wood inherently suffers from other drawbacks including susceptibility to termite infestation, to rotting and to mildew. Also, the use of wood studs may potentially increase fire hazards.

In an attempt to circumvent the above mentioned disadvantages, some constructors have resorted to using metal studs. Such metal studs have been traditionally used mainly in the construction of commercial buildings. In commercial construction, they are typically assembled between elongated metal rails instead of the wood plates used in residential construction. Although metal studs provide some advantages, they nevertheless also inherently suffer from some drawbacks. For example, they are often considered to provide poor thermal and noise insulation. Also, assembly of metal frameworks involves different methods and tools than those used for wood frameworks. For example, with metal frameworks, the stud is fastened to the rail with screws as opposed to nails used for fastening wood studs to wood rails. Furthermore, the installation of components and fixtures such as electrical outlet boxes or the like to metal studs is more tedious and time consuming than installation of the same fixtures and components to wood studs.

Some of these problems have been recognized in the past, and, accordingly, some prior art documents disclose combination metal and wood studs for combining the advantages of both types of components. For example, U.S. Pat. No. 5,590,505 naming D. Dennis BOGLE as inventor issued Jan. 7, 1997 discloses a construction member having an elongated member with a longitudinal channel disposed therein. The elongated member has a C-shaped cross-sectional configuration for receiving and retaining fastening blocks at respective ends of the channel.

The blocks are dimensioned so as to substantially fill the cross-sectional space of the channel. The fastening blocks may receive nails driven through the upper and lower plates in a standard residential wall construction. End caps attached to the ends of the elongated members are also provided so that the load beating surface abutting an elongated member is not damaged by the elongated member's end.

U.S. Pat. No. 5,713,176 naming Donald Patrick HUNT as inventor issued Feb. 3, 1998 discloses a combination C- or U-shaped metal and composite construction stud. The stud is typically made out of galvanized steel and has an insert made of softer material located at strategically placed locations on the stud. Pointed fastening devices such as nails and/or screws may be used to fasten other structural components to the studs.

Although these prior art composite studs made out of both a frame member and a core circumvent some of the above mentioned disadvantages, they nevertheless suffer from at least one major drawback. Indeed, they require that the core component or insert be slidably inserted into the elongated member or frame in the direction of the longitudinal axis of the elongated member or frame from one of its longitudinal ends. This may prove to be impossible or difficult in numerous situations.

This limitation may greatly deter the overall appeal of the composite stud solution. Accordingly, there exists a need for an improved composite stud.

SUMMARY OF THE INVENTION

Advantages of the present invention include that the proposed composite stud may be used for providing structural support in the context of building frameworks. Also, the proposed composite stud is intended to combine the advantages associated with conventional wood and metal studs.

The proposed composite stud reduces the disadvantages such as susceptibility to warping, rotting, mildew and termite infestation associated with conventional wood studs. It also reduces the risks of flammability associated with wood studs. Furthermore, it reduces the need for continuing the depletion of forest resources and may even allow for recycling of otherwise unusable wood stud segments.

The proposed composite stud also provides better insulation than the conventional metal studs to both heat and noise. Furthermore, it advantageously provides the fastening features commonly associated with wood studs allowing for fastening of various types of components using conventional nails, screws or the like through a set of quick and ergonomic steps.

Still further, the proposed composite stud allows for assembly of the core component and frame member through a set of quick and ergonomic steps without requiring special tooling or manual dexterity. The core component may readily be inserted into the frame member and assembled thereto in a snap-like manner without requiring that the core components be slidably inserted in an end section of the longitudinal member.

Still further, the proposed composite stud is designed so as to be manufactured using conventional forms of manufacturing so as to provide a composite stud that will be economically feasible, long-lasting and relatively trouble free in operation.

According to an aspect of the present invention, there is provided a composite stud comprising:

a generally elongated frame member, the frame member defining a frame longitudinal axis, a frame first longitudinal end and a generally opposed frame second longitudinal end; the frame member having a generally U-shaped-cross-sectional configuration defining a frame base wall and a pair of frame side walls; the frame base wall defining a base wall inner surface, a base wall outer surface and a pair of opposed base wall main peripheral edges; each of the frame side walls defining a corresponding side wall inner surface, a side wall outer surface, a side wall first main edge and a generally opposed side wall second main edge; each of the side wall first main edges being attached to a corresponding one of the base wall main peripheral edges; the frame side walls extending from the frame base wall so that the side wall inner surfaces are in a generally facing relationship relative to each other, the frame base wall and the frame side walls together defining a generally open base channel, the base channel having a channel opening located generally opposite the frame base wall;

core component; the core component defining a core longitudinal axis, a core first longitudinal end and an opposed core second longitudinal end; the core component having a substantially rectangular cross-sectional configuration defining a core first main wall, a core second main wall, a core first auxiliary wall and a core second auxiliary wall; the core component being configured and sized so as to be insertable into the base channel with the core first main wall positioned generally adjacent the base wall inner surface and the core first and second auxiliary walls positioned generally adjacent a corresponding one of the side wall inner surface, the core component being configured and sized for allowing the core component to be at least partially inserted in the base channel from an insertion direction generally angled relative to the frame longitudinal axis in a snap-like manner, the insertion recess section forming a fifth wall of the core component and extending generally at an angle between the core first main wall and the core second auxiliary wall;

retaining means positioned between the frame member and the core component for retaining at least a portion of the core component in the base channel once inserted thereinto.

Typically, the retaining means releasably retains at least a portion of the core component in the base channel once inserted thereinto so as to selectively allow withdrawal of the at least a portion of the core component from the base channel.

Typically, the core component is also configured and sized so as to be releasably and at least partially retained in the base channel by the frame side walls once inserted in the base channel so as to selectively allow withdrawal of the at least a portion of the core component from the base channel.

Preferably, the core component is configured and sized for allowing the core component to be at least partially inserted in the base channel from an insertion direction generally perpendicular relative to the frame longitudinal axis.

Preferably, at least one of the side wall first main edges is pivotally attached to a corresponding one of the base wall main peripheral edges so as to allow the corresponding frame side wall to pivot between a side wall first position and a side wall second position, wherein the pivotable frame side wall is in a generally perpendicular relationship relative to the frame base wall when the pivotable frame side wall is in the side wall first position and the pivotable frame side wall is in an outwardly angled relationship relative to the frame base wall when the pivotable frame side wall is in the side wall second position; whereby when the pivotable frame side wall is in the side wall first position it collaborates with the other frame side wall for locking at least a section of the core component in the base channel and when the pivotable frame side wall is in the side wall second position it facilitates the insertion of at least a section of the core component into the base channel along the insertion direction.

Typically, the frame member is provided with a biasing means for biasing the pivotable frame side wall towards the side wall first position.

Preferably, the frame base wall and the pivotable frame side wall are made out of an integral and generally resilient piece of material, the at least one of the side wall first main edges being generally resiliently attached to a corresponding one of the base wall main peripheral edges.

Preferably, the frame member is made out of galvanized steel and the core component is made out of wood.

Typically, the retaining means includes a retaining flange extending inwardly from the side wall inner surface adjacent the side wall second main edge of at least one of the frame side walls.

Preferably, the retaining means includes a retaining flange extending inwardly from the side wall inner surface adjacent the side wall second main edge of both the frame side walls, the retaining flanges extending generally towards each other.

Preferably, the core first auxiliary wall is provided with a first retaining slot extending longitudinally at least partially therealong, the first retaining slot being configured and sized for receiving at least a section of one of the retaining flanges when the core component is inserted into the base channel.

Preferably, the first retaining slot extends generally transversely towards the core second auxiliary wall in a generally transversal slot plane, the slot plane generally dividing the core component into a core first cross-sectional area and a core second cross-sectional area.

Alternatively, a section of the core first auxiliary wall located in the core first cross-sectional area is inwardly recessed relative to a section of the core first auxiliary wall located in the core second cross-sectional area.

Preferably, the core second auxiliary wall is provided with a second retaining slot extending longitudinally at least partially therealong, the second retaining slot being configured and sized for receiving at least a section of the other one of the retaining flanges when the core component is inserted into the base channel.

Typically, the first and second retaining slots extend generally transversally towards each other in a generally transversal slot plane, the slot plane generally dividing the core component into a first core cross-sectional area and a second core cross-sectional area; wherein a section of the core first auxiliary wall located in the core first cross-sectional area is inwardly recessed relative to a section of the core first auxiliary wall located in the core second cross-sectional area and also wherein a section of the core second auxiliary wall located in the core first cross-sectional area is inwardly recessed relative to a section of the core second auxiliary wall located in the core second cross-sectional area.

Preferably, the first retaining slot defines a slot first wall located adjacent the core first cross-sectional area and a slot second wall located adjacent the core second cross-sectional area; the slot first wall extending at an angle relative to the slot plane, the slot first wall extending towards the slot second wall in a direction leading towards the core second auxiliary wall; whereby the configuration of the first retaining slot facilitates the insertion of at least a section of the core component into the base channel along the insertion direction.

Preferably, the fifth wall has a generally flat configuration or a generally arcuate configuration.

Alternatively, the core component is provided with a pair of insertion recess sections, the insertion recess sections forming a fifth wall and a sixth wall of the core component respectively and extending generally at an angle respectively between the core first main wall and the core first and second auxiliary walls, respectively; wherein the insertion recess sections are configured and sized for facilitating the insertion of at least a section of the core component into the base channel along a direction generally perpendicular to the frame longitudinal axis.

Alternatively, the core component is also configured and sized so that the retaining flanges abuttingly contact the core second main wall when the core component is inserted into the base channel.

Alternatively, the frame base wall defines a frame reinforcement recess, the core first main wall being provided with a generally complementarily-shaped corresponding core reinforcement recess for generally fittingly receiving the frame reinforcement recess when the core component is inserted into the base channel.

According to another aspect of the present invention, there is provided a core component for use with generally elongated frame member so as to form a composite stud, the frame member defining a frame longitudinal axis, a frame first longitudinal end and a generally opposed frame second longitudinal end; the frame member having a generally U-shaped cross-sectional configuration defining a frame base wall and a pair of frame side walls; the frame base wall defining a base wall inner surface, a base wall outer surface and a pair of opposed base wall main peripheral edges; each of the frame side walls defining a corresponding side wall inner surface, a side wall outer surface, a side wall first main edge and a generally opposed side wall second main edge; each of the side wall first main edges being attached to a corresponding one of the base wall main peripheral edges; each of the side wall second main edges being provided with a corresponding retaining flange; the frame side walls being in a generally perpendicular relationship relative to the base wall and the side wall inner surfaces being in a generally facing relationship relative to each other so as to define a base channel therebetween; the core component comprises:

a core body, the core body defining a core longitudinal axis, a core first longitudinal end and an opposed care second longitudinal end; the core body having a substantially rectangular cross-sectional configuration defining a core first main wall, a core second main wall, a core first auxiliary wall and a core second auxiliary wall; the core body being configured and sized so as to be insertable into the base channel with the core first main wall positioned generally adjacent the base wall inner surface and the core first and second auxiliary walls positioned generally adjacent a corresponding one of the side wall inner surface; the core first auxiliary wall being provided with a first retaining slot extending longitudinally at least partially therealong, the first retaining slot being configured and sized for receiving at least a section of one of the retaining flanges when the core component is inserted into the base channel; the core second auxiliary wall being provided with a second retaining slot extending longitudinally at least partially therealong, the second retaining slot being configured and sized for receiving at least a section of the other one of the retaining flanges when the core component is inserted into the base channel;

the core component being provided with an insertion recess section, the insertion recess section forming a fifth wall of the core component and extending generally at an angle between the core first auxiliary wall and the core first main wall; wherein the insertion recess section is configured and sized for facilitating the insertion of at least a section of the core component into the base channel from an insertion direction generally angled relative to said frame longitudinal axis in a snap-like manner.

Typically, the fifth wall extends generally at an angle between the core first auxiliary wall and the core first main wall.

Alternatively, the core first main wall is short relative to the core second main wall and the second retaining slot is a recessed section, the fifth wall being generally arcuate and extending between the core first auxiliary wall and the short core first main wall.

In one embodiment, the core component further includes an attachment board secured to the core body, the attachment board extending generally outwardly and transversely from the core second main wall along the core second auxiliary wall the from a position adjacent the second retaining slot.

Other objects and advantages of the present invention will become apparent from a careful reading of the detailed description provided herein, with appropriate reference to the accompanying drawings.

BRIEF DESCRIPTION OF THE DRAWINGS

Embodiments of the present invention will now be disclosed, by way of example, in reference to the following drawings in which like reference characters indicate like elements throughout.

DETAILED DESCRIPTION OF THE PREFERRED EMBODIMENTS

With reference to the annexed drawings the preferred embodiments of the present invention will be herein described for indicative purpose and by no means as of limitation.

Figure 11:
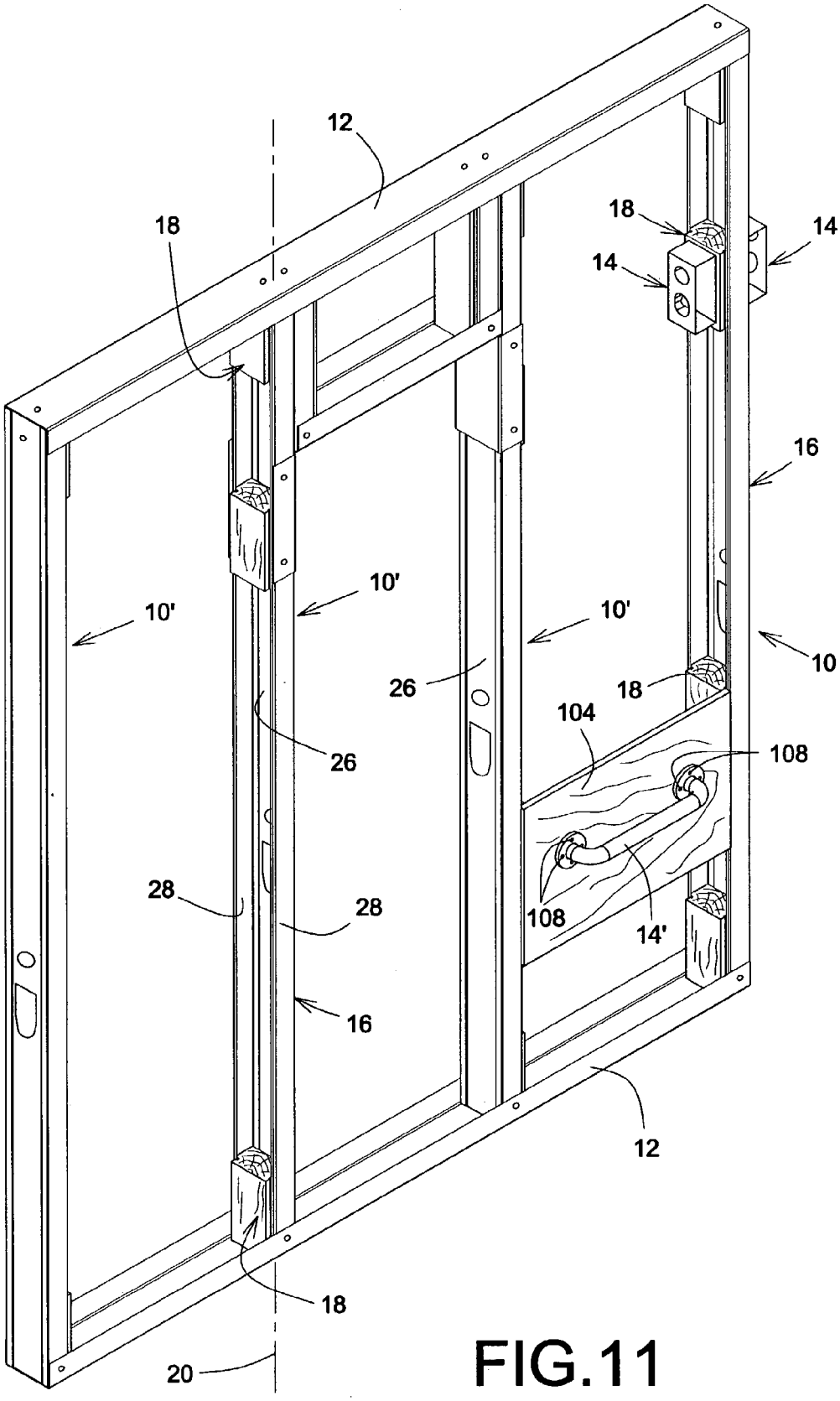
FIG. 11, in a perspective view, illustrates a composite stud in accordance with an embodiment of the present invention, the composite stud is shown being used with other composite studs extending in a generally parallel relationship relative thereto for attaching and supporting generally horizontal plates part of a conventional building frame; the composite stud is also shown being used for anchoring an accessory such as a conventional electrical box thereto.

Referring to FIG. 11, there is shown a composite stud 10 in accordance with an embodiment of the present invention. The composite stud 10 is shown being used with other composite studs 10' extending in a generally parallel relationship relative thereto for attaching and supporting generally horizontal plates 12 part of a conventional building frame. The composite stud 10 is also shown being used for anchoring an accessory such as a conventional electrical box 14 thereto. It should be understood that the composite stud 10 could be used in other contexts without departing from the scope of the present invention.

Figure 2:
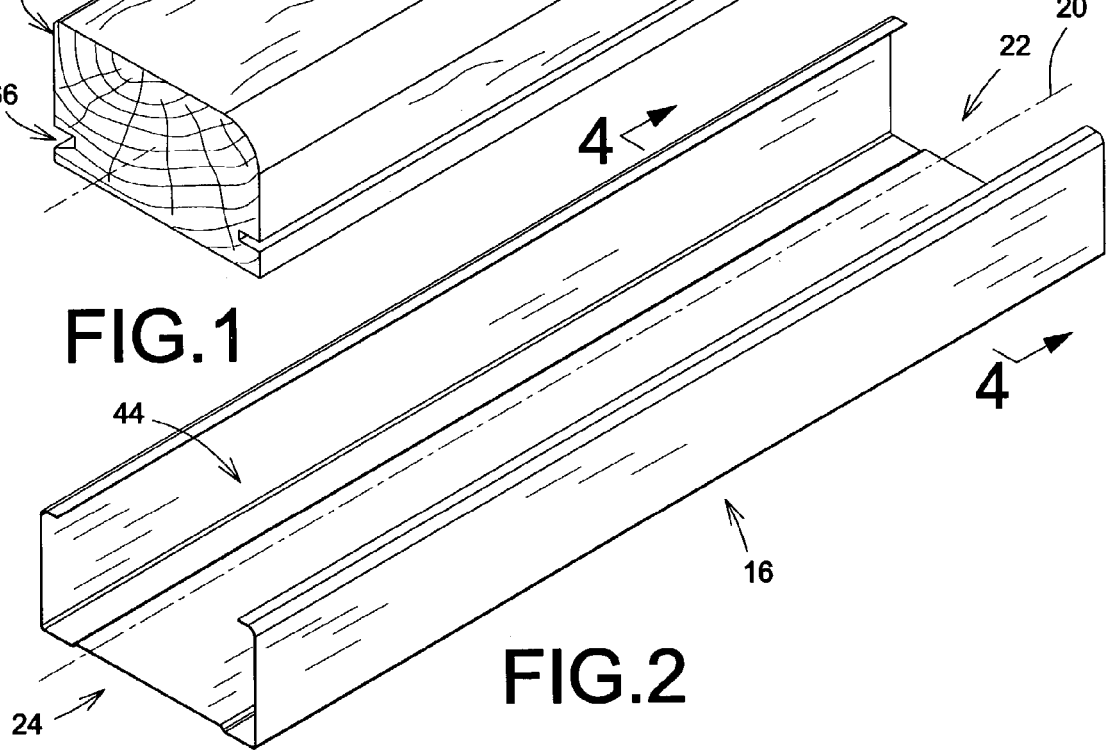
FIG. 2, in a perspective view, illustrates a frame member part of a composite stud in accordance with an embodiment of the present invention.

The composite stud 10 includes a generally elongated frame member 16 and a core component 18 attached thereto. As illustrated more specifically in FIG. 2, the frame member 16 defines a frame longitudinal axis 20, a frame first longitudinal end 22 and a generally opposed frame second longitudinal end 24.

Figure 4:
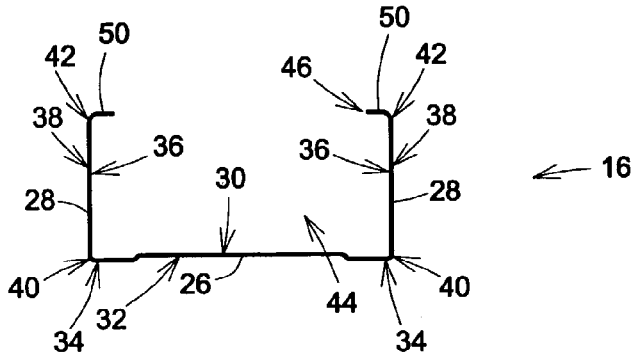
FIG. 4, in a transversal cross-sectional view taken along arrows 4—4 of FIG. 2, illustrates the cross-sectional configuration of the frame member shown in FIG. 2.

As illustrated more specifically in FIG. 4, the frame member 16 typically has a generally U-shaped cross-sectional configuration. The frame member 16 hence defines a frame base wall 26 and a pair of frame side walls 28. The frame base wall 26, in turn, defines a base wall inner surface 30, an opposed base wall outer surface 32 and a pair of generally opposed base wall main peripheral edges 34.

Each frame side wall 28, in turn, defines a corresponding side wall inner surface 36, an opposed side wall outer surface 38, a side wall first main edge 40 and a generally opposed side wall second main edge 42.

Each side wall first main edge 40 is attached to a corresponding one of the base wall main peripheral edges 34. The frame side walls 28 typically extend in a generally perpendicular relationship relative to the base wall 26.

Alternatively, the frame side walls 28 may extend at an angle relative to the base wall 26. Hence, although the frame member typically has a generally U-shaped cross-sectional configuration, it should be understood that the frame member 16 could have other cross-sectional configurations without departing from the scope of the present invention.

The side wall inner surfaces 36 typically extend in a generally facing relationship relative to each other. Hence, the base wall 26 and the side wall 28 together define a generally open base channel 44. The base channel 44 defines a channel longitudinal opening 46 located generally opposite the frame base wall 26. As illustrated more specifically in FIGS. 7, 7*a* and 7*b*, at least one of the side walls first main edges 40 is typically pivotally attached to a corresponding one of the base wall main peripheral edges 34. The pivotal link between at least one of the side wall first main edges 40 and a corresponding one of the base wall main peripheral edges 34 allows the corresponding frame side wall 28 to pivot between a side wall first position illustrated in FIGS. 6, 6*a* and 6*b* and a side wall second position illustrated in FIGS. 7, 7*a* and 7*b*.

Figure 6:
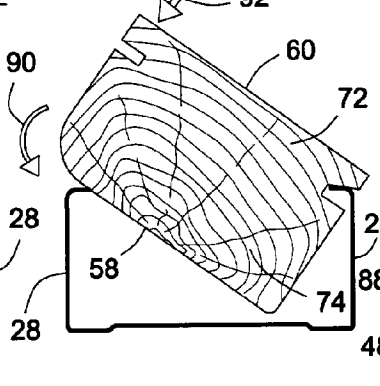
FIG. 6, in a transversal cross-sectional view, illustrates the core component shown in FIG. 5, having contacted the frame member also shown in FIG. 5 and about-to be pivoted thereinto.
Figure 5:
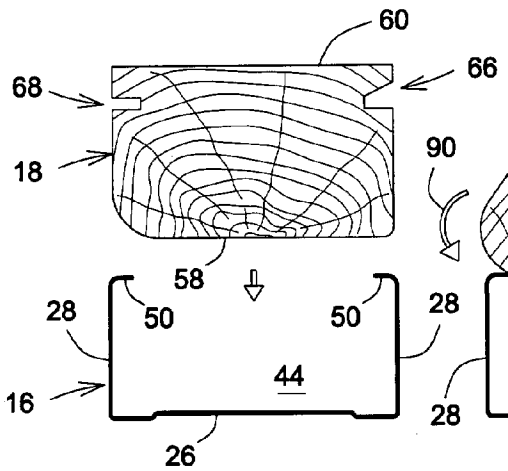
FIG. 5, in a transversal cross-sectional view, illustrates the core component shown in FIGS. 1 and 3 about to be inserted in the frame member shown in FIGS. 2 and 4.
Figures 5A, 5B, 6A, 6B, 7A, 7B, 8A, 8B:
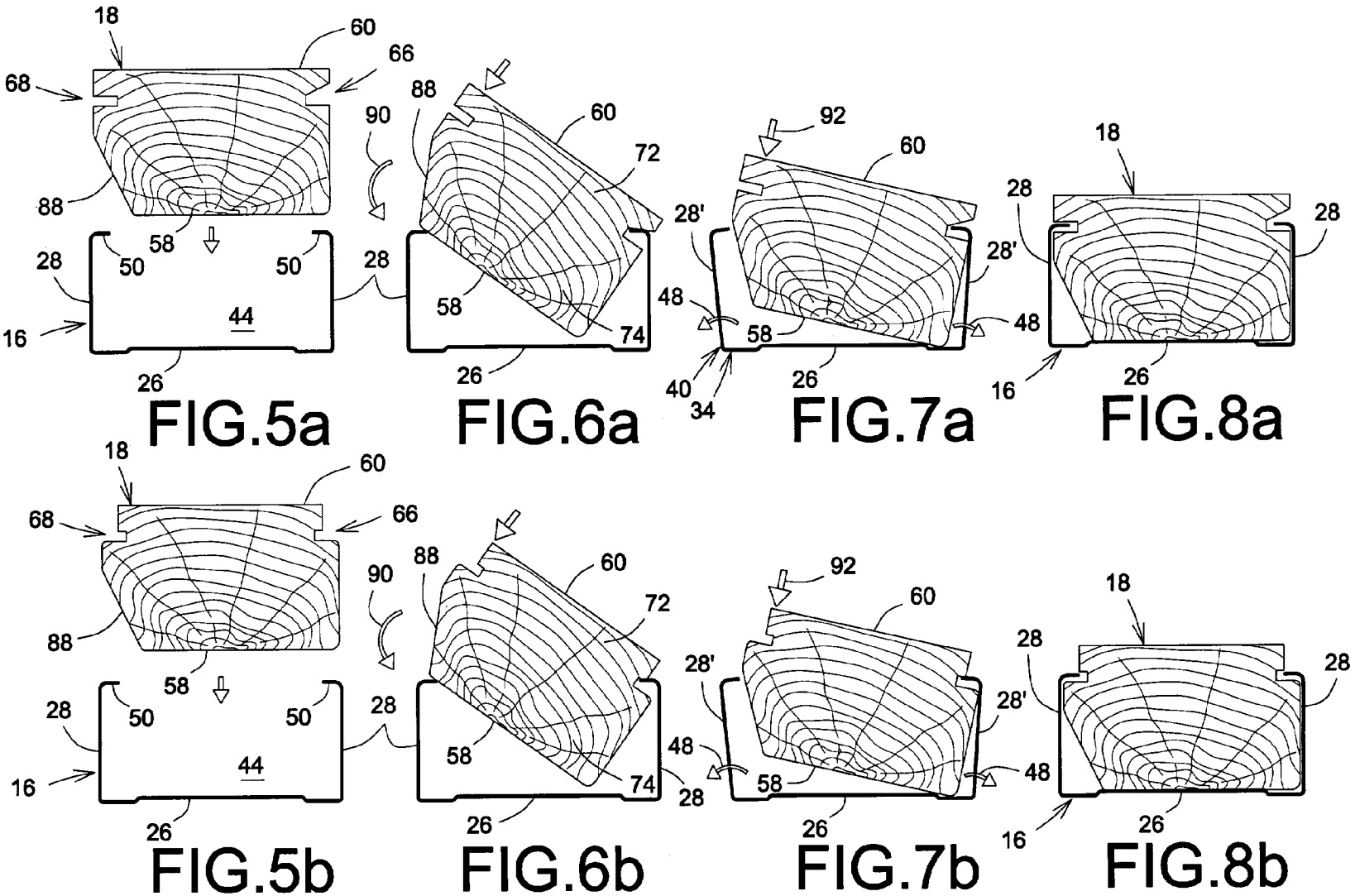
FIG. 5*a,* in a view similar to FIG. 5, illustrates the core component and the frame member shown in FIGS. 3*a* and 4, respectively.
FIG. 5*b,* in a view similar to FIG. 5, illustrates the core component and the frame member shown in FIGS. 3*b* and 4, respectively.
FIG. 6*a,* in a view similar to FIG. 6, illustrates the core component shown in FIG. 5*a* having contacted the frame member also shown in FIG. 5 and about to be pivoted thereinto.
FIG. 6*b,* in a view similar to FIG. 6, illustrates the core component shown in FIG. 5*b* having contacted the frame member also shown in FIG. 5 and about to be pivoted thereinto.
FIG. 7*a,* in a view similar to FIG. 7, illustrates the core component shown in FIGS. 5*a* and 6*a,* being pivoted into the frame member, also shown in FIGS. 5*a* and 6*a;*
FIG. 7*b,* in a view similar to FIG. 7, illustrates the core component shown in FIGS. 5*b* and 6*b,* being pivoted into the frame member, also shown in FIGS. 5*b* and 6*b;*
FIG. 8*a,* in a view similar to FIG. 8, illustrates the core component shown in FIGS. 5*a* through 7*a,* inserted in the channel formed by the frame member also shown in FIGS. 5*a* through 7*a;*
FIG. 8*b,* in a view similar to FIG. 8, illustrates the core component shown in FIGS. 5*b* through 7*b,* inserted in the channel formed by the frame member also shown in FIGS. 5*b* through 7*b;*

As illustrated in FIGS. 6, 6*a* and 6*b*, when the pivotable frame side wall 28 is in the side wall first position, the pivotable frame side wall 28 typically extends in a generally perpendicular relationship relative to the frame base wall 26. However, as shown in FIGS. 7, 7*a* and 7*b*, when the pivotable frame side wall 28' is in side wall second position, the pivotable frame side wall 28' typically extends in an outwardly angled relationship relative to the frame base wall 26.

Figure 7:
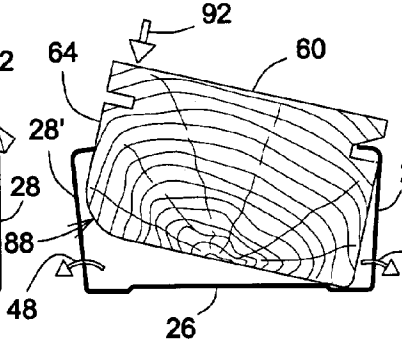
FIG. 7, in a transversal cross-sectional view, illustrates the core component shown in FIGS. 5 and 6, being pivoted into the frame member, also shown in FIGS. 5 and 6.

Pivotal movement of the pivotable frame side wall 28' relative to the frame base wall 26 is illustrated in FIGS. 7, 7*a* and 7*b* by the arrow 48. Preferably, both frame side walls 28 are attached to the frame base wall 26 so as to allow pivotal movement therebetween.

As will be hereinafter disclosed in greater detail, when the pivotable frame side walls 28 are in their side wall first position, they collaborate with each other for locking at least a section of the core component 18 in the base channel 44. Conversely, when the pivotable frame side walls 28' are in their side wall second position, their configuration facilitates the insertion of at least a section of the core component 18 into the base channel 44 in an insertion direction generally angled relative to the frame longitudinal axis 20.

Preferably, the frame member 16 is provided with a biasing means for biasing the pivotal frame side walls 28 towards the side wall first position. Typically, the frame base wall 26 and the frame side walls 28 are made out of an integral and generally resilient piece of material. Hence, the side wall first main edges 40 are typically generally resiliently attached to a corresponding one of the base wall main peripheral edges 34. The resiliency of the material hence typically acts as the biasing means.

By way of example, the frame member 16 could be made out of a generally thin piece of folded stainless or galvanized steel. It should however be understood that the frame member 16 could be made out of any other type of suitable material without departing from the scope of the present invention.

The composite stud 10 is also provided with a retaining means positioned between the frame member 16 and the core component 18 for retaining at least a portion of the core component 18 in the base channel 44 once inserted thereinto. Typically, the retaining means includes a keeper or retaining flange 50 extending inwardly from the side wall inner surface 36 adjacent the side wall second main edge 42 of at least one and preferably both the frame side wall 28.

Each retaining flange 50 typically extends in a direction generally towards the opposite side wall 28 or the opposite retaining flange 50. Each retaining flange 50 typically has a generally flat or cross-sectional rectilinear configuration. It should however be understood that the retaining flanges 50 could have other configurations and other orientations without departing from the scope of the present invention. It should also be understood that the retaining means could include other types of components or structures without departing from the scope of the present invention. For example, a strip of miniature hook and loop fiber could be affixed to one of the inner surfaces of the base channel 44 for interaction with a corresponding strip of miniature hook and loop fiber attached to the core component 18. Also, adhesives or other types of retaining protrusions could be used without departing from the scope of the present invention.

Preferably, the retaining means releasably retains at least a portion of the core component 18 into the base channel 44 so as to selectively allow withdrawal of the section of the core component 18 inserted into the base channel 44 therefrom when needed.

Figure 1:
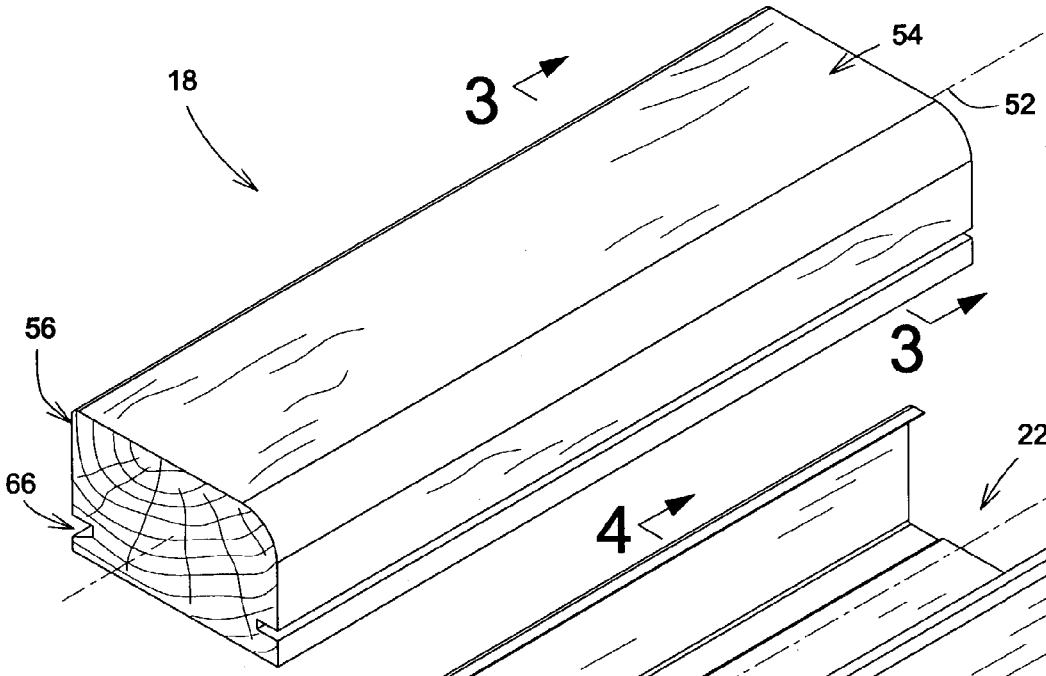
FIG. 1, in a perspective view, illustrates a core component part of a composite stud in accordance with an embodiment of the present invention.

As illustrated more specifically in FIG. 1, the core component 18 defines a core longitudinal axis 52, a core first longitudinal end 54 and an opposed core second longitudinal end 56. The core component 18 is configured and sized for allowing the latter to be at least partially inserted in the base channel 44 from an insertion direction generally angled relative to the frame longitudinal axis 20. In other words, the core component 18 is configured and sized so as to allow insertion thereof into the base channel 44 not only by a generally axial sliding action such as illustrated in FIG. 9, but also by a snapping action from an insertion direction generally angled relative to the frame longitudinal axis 20 such as illustrated in FIGS. 5 through 8 and 10.

The core component 18 is also configured and sized to be at least partially retained in the base channel 44 by the frame side walls 28 and/or the retaining means once the core component 18 is inserted into the base channel 44. Typically, the core component 18 is configured and sized so as to be releasably and at least partially retained in the base channel 44 by the frame side walls 28 and/or the retaining means so as to selectively allow withdrawal of the portion of the core component 18 inserted in the base channel 44 therefrom.

Typically, the core component 18 is configured and sized so as to be inserted in the base channel 44 from an insertion direction generally perpendicular relative to the frame longitudinal axis 20. However, the core component 18 could be configured and sized for allowing insertion into the base channel 44 from another angled direction relative to the frame longitudinal axis 20.

Figure 3B:
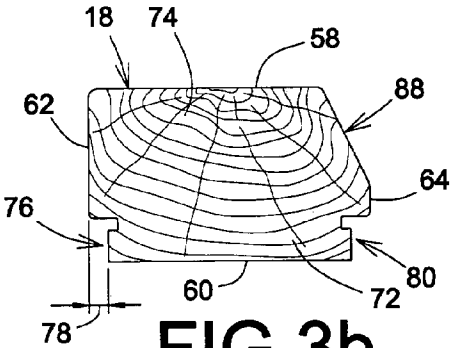
FIG. 3*b,* in a view similar to FIG. 3, illustrates the cross-sectional configuration of a core component in accordance with yet another embodiment of the present invention.
Figure 3A:
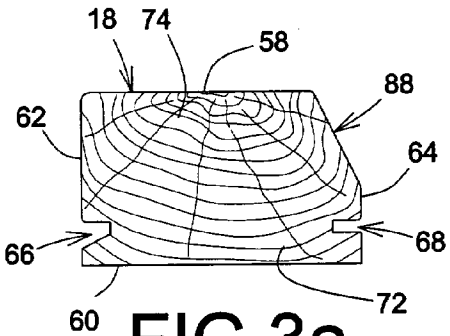
FIG. 3*a,* in a view similar to FIG. 3, illustrates the cross-sectional configuration of a core component in accordance with another embodiment of the present invention.
Figure 3:
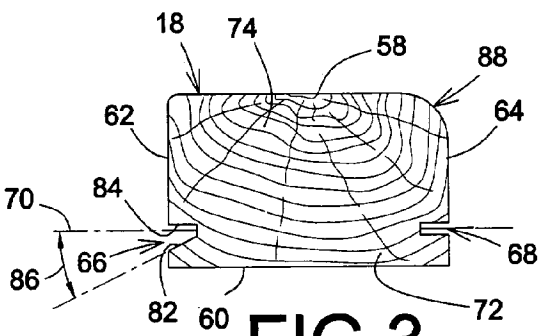
FIG. 3, in a transversal cross-sectional view taken along arrows 3—3 of FIG. 1, illustrates the cross-sectional configuration of the core component shown in FIG. 1.

As illustrated more specifically in FIGS. 3, 3*a* and 3*b*, the core component 18 typically has a substantially rectangular cross-sectional configuration defining a core first main wall 58, a generally opposed core second main wall 60, a core first auxiliary wall 62 and a generally opposed core second auxiliary wall 64. It should be understood that the core component 18 could have other cross-sectional configurations without departing from the scope of the present invention.

The core component 18 is configured and sized so as to be insertable into the base channel 44 typically with the core first main wall 58 positioned generally adjacent the base wall inner surface 30 and the core first and second auxiliary wall 62, 64 positioned generally adjacent a corresponding one of the side wall inner surfaces 36.

The core first auxiliary wall 62 is typically provided with a first retaining slot 66 extending longitudinally at least partially therealong. The first retaining slot 66 is configured and sized for receiving at least a section of one of the retaining flanges 50 when the core component 18 is inserted into the fame channel 44.

Typically, the core second auxiliary wall 64 is provided with a second retaining slot 68 extending longitudinally at least partially therealong. The second retaining slot 68 is configured and sized for receiving at least a section of the other one of the retaining flanges 50 when the core component 18 is inserted into the base channel 44.

The first retaining slot 66 extends generally transversely towards the core second auxiliary wall 64 in a generally transversal slot plane 70. When both the first and the second retaining slot 66, 68 are present, they typically extend generally transversely towards each other in the slot plane 70. It should however be understood that the first and second retaining slots 66, 68 could extend in distinctive geometrical planes without departing from the scope of the present invention.

Figures 12, 13, 14, 15, 16:
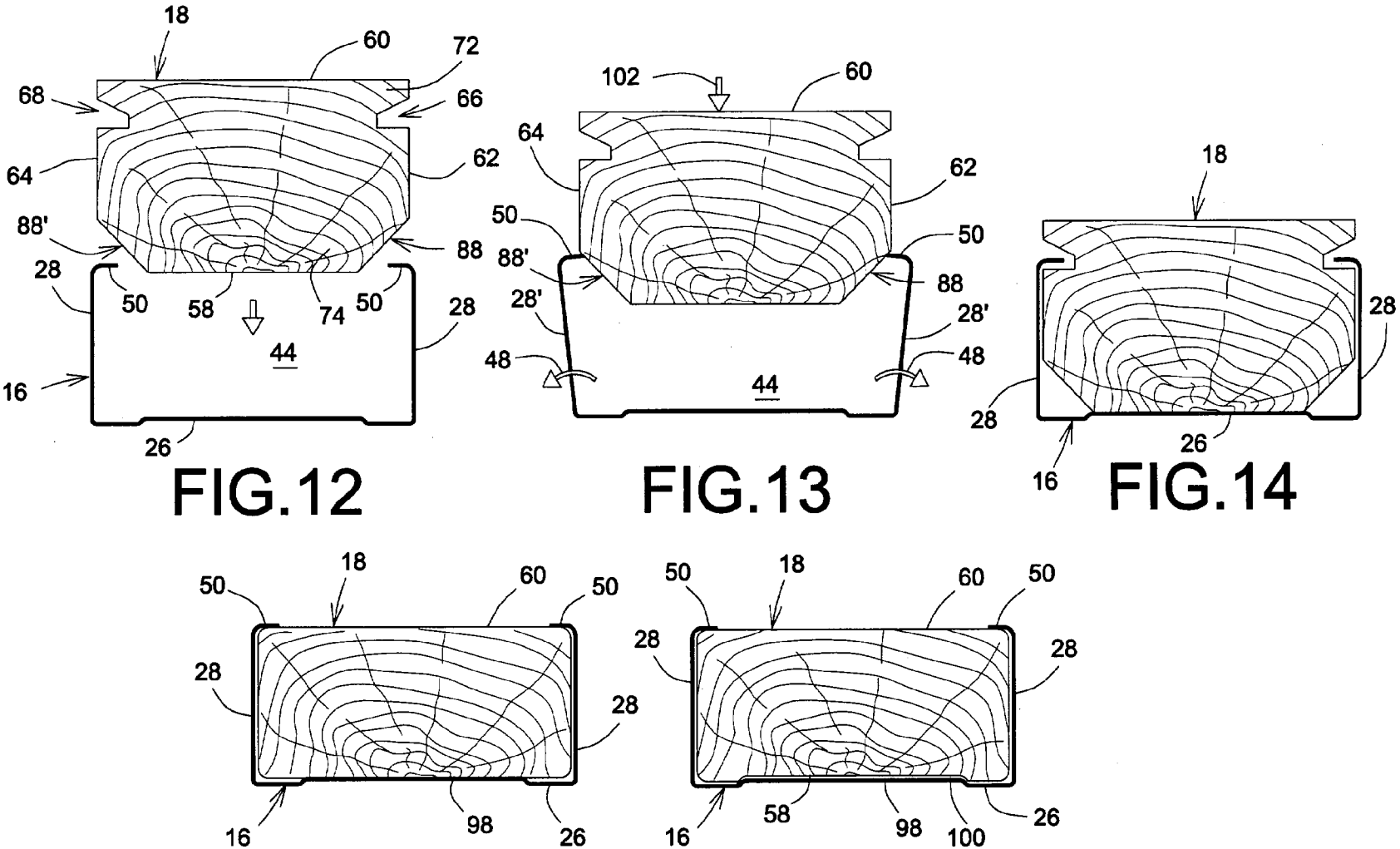
FIG. 12, in a view similar to FIG. 5, illustrates the cross-sectional configuration of a core component in accordance with another embodiment of the present invention about to be inserted in the frame member shown in FIG. 4.
FIG. 13, in a view similar to FIG. 6, illustrates the core component shown in FIG. 12, having contacted the frame member also shown in FIG. 12 and about to be snapped thereinto.
FIG. 14, in a view similar to FIG. 8, illustrates the core component shown in FIGS. 12 and 13, inserted in the channel formed by the frame member also shown in FIGS. 12 and 13.
FIG. 15, in a view similar to FIG. 8, illustrates the cross-sectional configuration of a core component in accordance with another embodiment of the present invention inserted in the channel formed by the frame member shown in FIG. 4.
FIG. 16, in a view similar to FIG. 8, illustrates the cross-sectional configuration of a core component in accordance with another embodiment of the present invention inserted in the channel formed by the frame member shown in FIG. 4.

In an alternative embodiment of the invention shown in FIGS. 15 and 16, the core component 18 is configured and sized so that the retaining flanges 50 abuttingly contact the core second main wall 60 when the core component 18 is inserted into the base channel 44. In the embodiment illustrated throughout the figures, the frame base wall 26 defines a frame reinforcement recess 98. Typically, although by no means exclusively, the frame reinforcement recess 98 is generally centrally positioned relative to the frame base wall 26. The frame reinforcement recess 98 is intended to increase the structural rigidity of the frame member 16.

In the embodiment shown in FIG. 16, the core first main wall 58 is provided with a complementarily-shaped corresponding core reinforcement recess 100. The core reinforcement recess 100 is configured and sized for substantially fittingly receiving the frame reinforcement recess 98 when the core component 18 is inserted into the base channel 44.

In the embodiments shown in FIGS. 3 through 3*b* and 12, the slot plane 70 typically divides the core components 18 into a core first cross-sectional area 72 and a core second cross-sectional area 74. In the embodiment of the invention shown in FIGS. 3*b* and 5*b* through 8*b*, at least a recessed section 76 of the core first auxiliary wall 62 located in the core first cross-sectional area 72 is inwardly recessed relative to a section of the core first auxiliary wall 62 located in the core second cross-sectional area 74. The recessed section 76 is typically recessed by a recess distance indicated by arrow 78 in FIG. 3*b*. The recessed section 76 is provided for use as an insertion facilitating means for facilitating the insertion of the core component 18 into the base channel 44 in a snap-like action.

Typically, at least a section 80 of the core second auxiliary wall 64 located in the first cross-sectional area 72 is also inwardly recessed relative to a section of the core second auxiliary wall 64 located in the core second cross-sectional area 74. Both the first and second first cross-sectional area recessed sections 76, 80 are provided for further facilitating insertion of the core component 18 into the base channel 44 in a snap-like fashion.

In at least two other embodiments of the invention shown in FIGS. 3, 3*a*, 5 through 8, 5*a* through 8*a* and 12 through 14, the first retaining slot 66 defines a slot first wall 82 located adjacent the core first cross-sectional area 72 and a slot second wall 84 located adjacent the core second cross-sectional area 74. The slot first wall 82 extends at an angle relative to the slot plane 70 while the slot second wall 84 typically extends in a direction typically parallel to the slot plane 70.

The slot first wall 82 is typically beveled so as to extend towards the slot second wall 84 in a direction leading towards the core second auxiliary wall 64. The angle between the slot first wall 82 and the slot plane 70 is indicated by the reference numeral 86 in FIG. 3.

The configuration of the first retaining slot 66 is intended to facilitate the insertion of at least a section of the core component 18 into the base channel 44 in a snap-like manner. When a second retaining slot 68 is also present, the first and second retaining slots 66, 68 typically collaborate for facilitating the insertion of at least a section of the core component 18 into the base channel 44 in a snap-like manner.

As illustrated more specifically in FIGS. 3, 3*a*, 3*b* and 12, the core component 18 is typically provided with an insertion recess section 88. The insertion recess section 88 forms a fifth wall of the core component 18 and extends generally at an angle between the core first main wall 58 and the core second auxiliary wall 64.

The insertion recess section 88 is configured and sized for facilitating the insertion of at least a section of the core component 18 into the base channel 44 along the insertion direction and in a snap-like manner. In the embodiment shown in FIGS. 3*a* and 3*b*, the insertion recess section 88 has a generally flat configuration. In the embodiment shown in FIG. 3, the insertion recess section 88 has a generally rounded configuration.

In an embodiment of the invention shown in FIGS. 12 through 14, the core component 18 is provided with a pair of insertion recess sections 88, 88'. The insertion recess sections 88, 88' form respectively a fifth wall and a sixth wall of the core component 18 and extend generally at an angle respectively between the core first main surface 58 and the core first and second auxiliary surfaces 62, 64, respectively. The insertion recess sections 88, 88' are configured and sized for facilitating the insertion of at least a section of the core component 18 into the base channel 44 along a direction generally perpendicular to the frame longitudinal axis as indicated by arrow 102 in FIG. 13.

Figures 17, 18, 19, 20, 21:
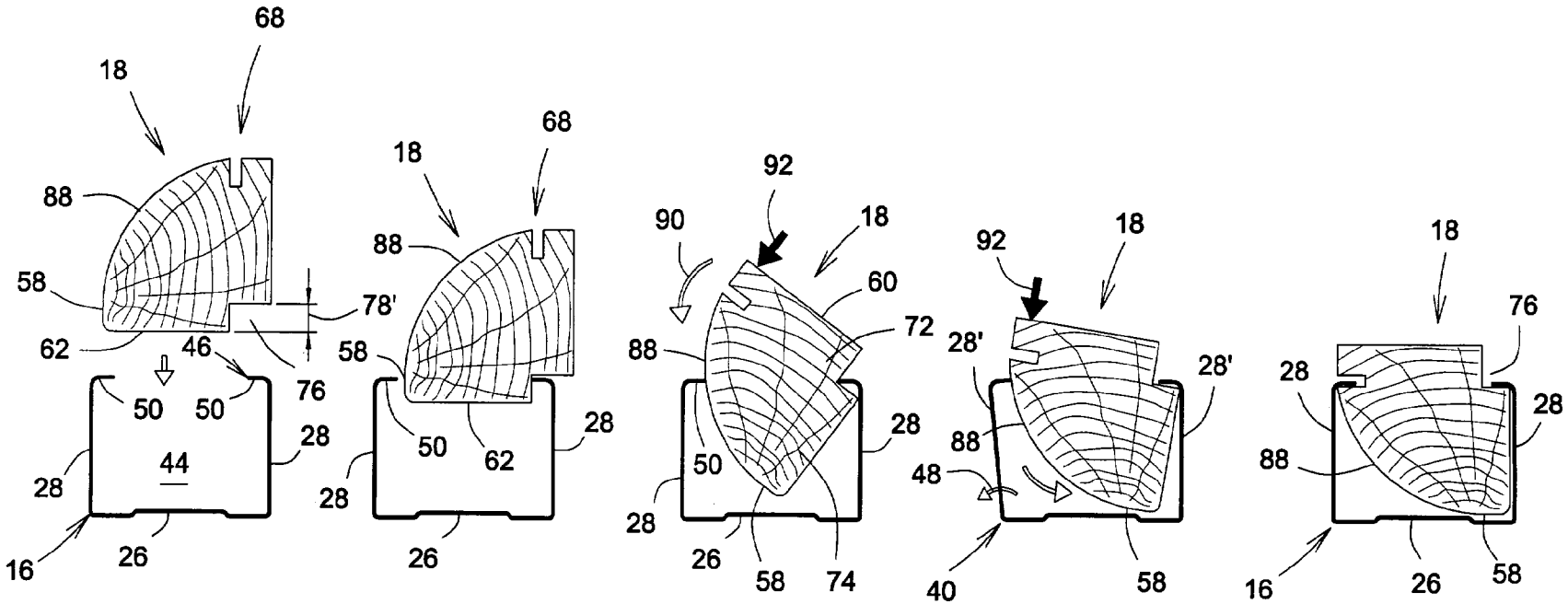
FIG. 17, in a view similar to FIG. 5*a,* illustrates the cross-sectional configuration of a core component in accordance with another embodiment of the present invention about to be inserted in the frame member shown in FIG. 4.
FIG. 18, in a view similar to FIG. 6*a,* illustrates the core component shown in FIG. 17, having contacted the frame member also shown in FIG. 17 and about to be pivoted thereinto.
FIG. 19, in a view similar to FIG. 7*a,* illustrates the core component shown in FIGS. 17 and 18, being pivoted into the channel formed by the frame member also shown in FIGS. 17 and 18.
FIG. 20, in a view similar to FIG. 7*a,* illustrates the core component shown in FIGS. 17 and 18, being pivoted further into the channel formed by the frame member also shown in FIGS. 17 and 18.
FIG. 21, in a view similar to FIG. 8*a,* illustrates the core component shown in FIGS. 17 and 18, inserted in the channel formed by the frame member also shown in FIGS. 17 and 18.
Figures 22, 23, 24, 25:
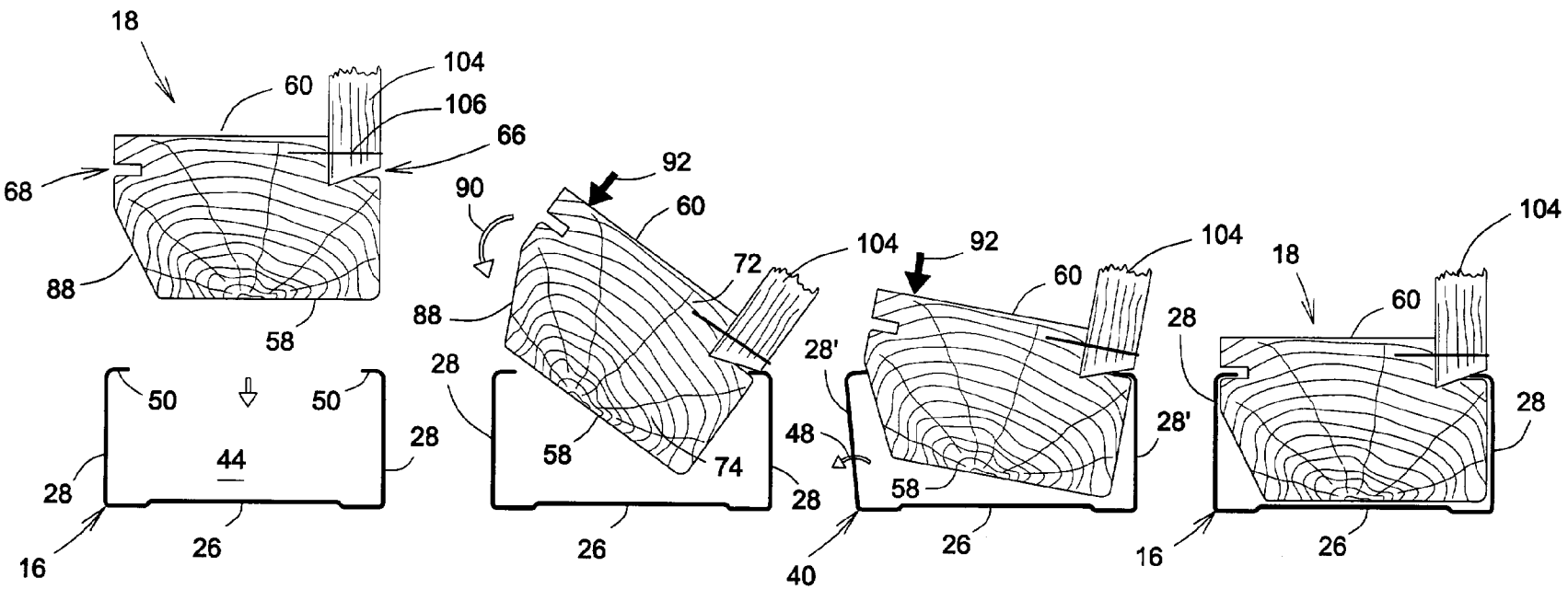
FIG. 22, in a view similar to FIG. 5*a,* illustrates the cross-sectional configuration of a core component in accordance with another embodiment of the present invention about to be inserted in the frame member shown in FIG. 4.
FIG. 23, in a view similar to FIG. 6*a,* illustrates the core component shown in FIG. 22, having contacted the frame member also shown in FIG. 22 and about to be pivoted thereinto.
FIG. 24, in a view similar to FIG. 7*a,* illustrates the core component shown in FIGS. 22 and 23, being pivoted into the channel formed by the frame member also shown in FIGS. 22 and 23.
FIG. 25, in a view similar to FIG. 8*a,* illustrates the core component shown in FIGS. 22 and 23, inserted in the channel formed by the frame member also shown in FIGS. 22 and 23.

In an embodiment of the invention shown in FIGS. 17 through 21, the core component 18 is provided with an arcuate insertion recess section 88, which extends generally between a substantially shortened core first main wall 58 and the second retaining slot 68. In this embodiment, the recessed section 76 is recessed by the recess distance 78', as shown in FIG. 17. This recess distance 78' allows for the insertion of the core first auxiliary wall 62 and part of the shortened core first main wall 58 into the relatively narrow channel longitudinal opening 46, as shown in FIG. 18. The arcuate insertion recess section 88 is configured and sized for facilitating the insertion of at least a section of the core component 18 into the base channel 44 along the directions shown by arrows 90 and 92 in FIG. 19.

In another embodiment of the invention shown in FIGS. 22 through 25, the core component 18 is provided with an attachment board 104 for securing thereto, via nails 108 and the like, additional structures such as plumbing fixtures, sinks, towel racks 14' or the like, as illustrated in FIG. 11. The attachment board 104 is typically connected to the recessed section 76 (or eventually the recessed section 80) of the core component 18 using nails, staples 106 and the like, so as to generally extend outwardly and transversely from the core second main wall 60 along the core first auxiliary wall 62 (or eventually the core second auxiliary wall 64). The attachment board 104 typically includes an angled end portion which when inserted into the recessed section 76 defines the first retaining slot 66, which is configured and sized for facilitating the insertion of at least a section of the core component 18 into the base channel 44 along the directions shown by arrows 90 and 92 in FIGS. 23 and 24.

The core component 18 is typically made of a generally soft yet rigid material that allows insertion therein of conventional pointed fastening components such as nails, screws, staples and the like. Typically, the core component 18 is made out of wood allowing for recycling of wood planks. Alternatively, the core component 18 could be made out of a polymeric resin or any other suitable material.

The frame member 16 and the core component 18 could be sold separately, provided in a kit or pre-assembled together. In use, a core component 18 may be readily and easily assembled to a frame member 16 in a snap-like manner through a set of ergonomical steps illustrated in FIGS. 5 through 8, 5*a* through 8*a*, 5*b* through 8*b*, and 12 through 14.

Figure 10:
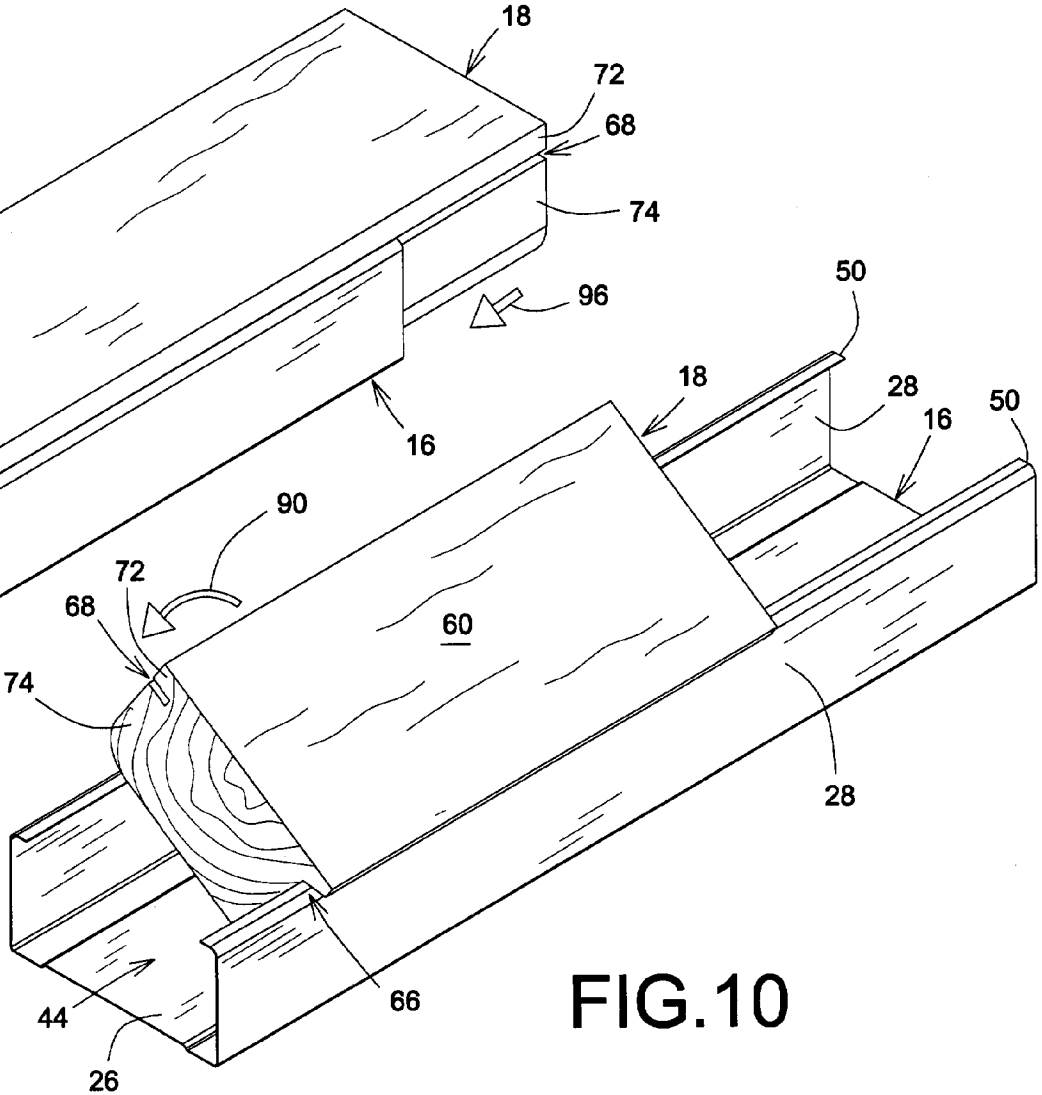
FIG. 10, in a perspective view, illustrates a core component being snappingly inserted into a frame member, both the core component and the frame member being part of a composite stud in accordance with an embodiment of the present invention.

As illustrated throughout the figures and in FIG. 10, the core component 18 can be assembled in an insertion direction positioned at an angle relative to the frame longitudinal axis 20. Alternatively, the core component 18 can be assembled to the frame member 16 through a relative sliding action along the frame longitudinal axis 20 as illustrated in FIG. 9.

When a core component 18 is assembled to the frame member 16 by a sliding action such as shown in FIG. 9, the first and second retaining slots 66, 68 are first aligned with the retaining flanges 50 and the core component 18 is then merely pushed in a sliding action indicated by arrow 96 so that the second core cross-sectional area 74 is inserted into the base channel 44.

When the core component 18 is assembled to the frame member 16 in a snap-like manner, the core component 18 is first aligned so as to be generally in register with the channel opening 46 such as shown in FIGS. 5 through 5*b*. The core component 18 is then pivoted according to arrow 90 in FIG. 6 and positioned so that at least a section of the second core cross-sectional area 74 is inserted into the base channel 44 and so that one of the retaining flanges 50 is inserted in the first retaining slot 66.

As shown in FIGS. 6 and 6*a*, in at least some embodiments of the invention, the angle of the slot first wall 82 facilitates insertion of the corresponding retaining flanges 50 into the first retaining slots 66. In the embodiment shown in FIG. 6*b*, the first cross-sectional area recess 76 plays substantially the same role, facilitating insertion of the retaining flange 50 into either one of the first or second retaining slots 66, 68.

A pressure schematically illustrated by arrow 92 is then applied typically on the core second main wall 60 adjacent the core second auxiliary wall 64. Pivoting movement of at least one of the frame side walls 28 indicated by arrow 48 and/or the presence of the insertion recessed section 88 allows for the second core cross-sectional area 74 to be snappingly inserted into the base channel 44 as shown in FIGS. 7 through 7*b*.

Figure 8:
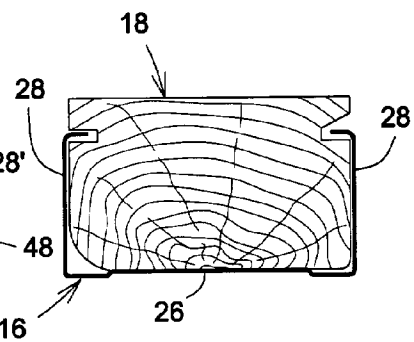
FIG. 8, in a transversal cross-sectional view, illustrates the core component shown in FIGS. 5 through 7, inserted in the channel formed by the frame member also shown in FIGS. 5 through 7.
Figure 9:
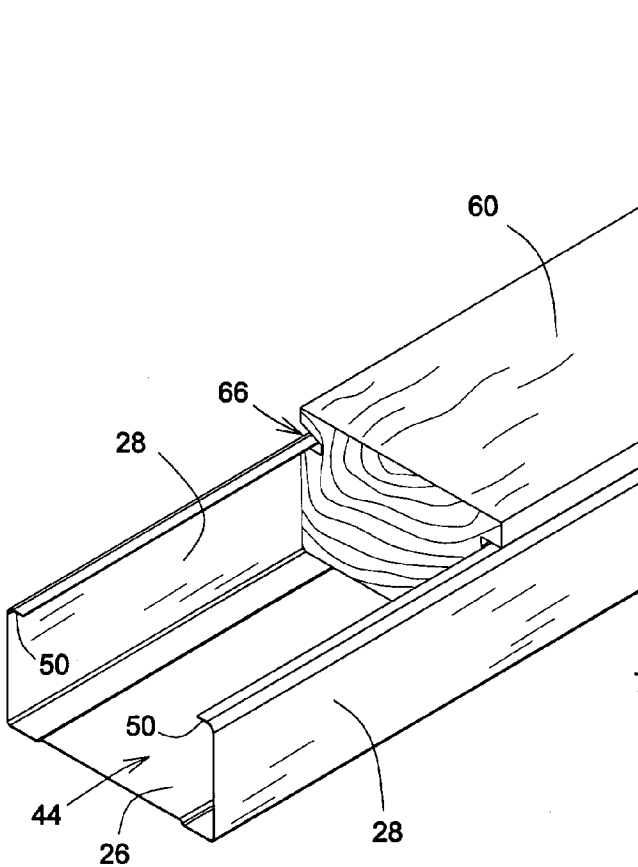
FIG. 9, in a perspective view, illustrates a core component being slidably and longitudinally inserted into a frame member, both the core component and the frame member being part of a composite stud in accordance with an embodiment of the present invention.

Once the second retaining slot 78 reaches the corresponding-retaining flange 50, the resilient nature of the material used for forming the frame member 16 pivots the frame side walls 28 towards the side wall first configuration shown in FIG. 8 through 8*b* with the retaining flanges 50 inserted in corresponding first and second retaining slots 66, 68 so as to secure the second core cross-sectional area 74 in the base channel 44.

Once the second core cross-sectional area 74 is inserted and retained within the base channel 44, the core component 18 may be used to structurally solidify the frame member 16, improve thermal and acoustical insulation thereof and/or it can be slid in desired location along the frame member 16 to be used as an anchoring structure for anchoring accessories and components such as the electrical box 14 or any other components through the use of conventional fastening components such as screws, nails, staples or the like.

Although the present composite building stud has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A composite stud comprising:

a generally elongated frame member, said frame member defining a frame longitudinal axis, a frame first longitudinal end and a generally opposed frame second longitudinal end; said frame member having a generally U-shaped cross-sectional configuration defining a frame base wall and a pair of frame side walls; said frame base wall defining a base wall inner surface, a base wall outer surface and a pair of opposed base wall main peripheral edges; each of said frame side walls defining a corresponding side wall inner surface, a side wall outer surface, a side wall first main edge and a generally opposed side wall second main edge; each of said side wall first main edges being attached to a corresponding one of said base wall main peripheral edges; said frame side walls extending from said frame base wall so that said side wall inner surfaces are in a generally facing relationship relative to each other, said frame base wall and said frame side walls together defining a generally open base channel, said base channel having a channel opening located generally opposite said frame base wall;

a core component; said core component defining a core longitudinal axis, a core first longitudinal end and an opposed core second longitudinal end; said core component having a substantially rectangular cross-sectional configuration defining a core first main wall, a core second main wall, a core first auxiliary wall and a core second auxiliary wall; said core component being configured and sized so as to be insertable into said base channel with said core first main wall positioned generally adjacent said base wall inner surface and said core first and second auxiliary walls positioned generally adjacent a corresponding one of said side wall inner surface, said core component being provided with an insertion recess section configured and sized to allow said core component to be at least partially inserted in said base channel from an insertion direction generally angled relative to said frame longitudinal axis in a snap-like manner, said insertion recess section forming a fifth wall of said core component and extending generally at an angle between said core first main wall and said core second auxiliary wall;

retaining means positioned between said frame member and said core component for retaining at least a portion of said core component in said base channel once inserted thereinto.

2. A composite stud as recited in claim 1 wherein said retaining means releasably retains at least a portion of said core component in said base channel once inserted thereinto so as to selectively allow axial withdrawal of said at least a portion of said core component from said base channel.

3. A composite stud as recited in claim 1 wherein said core component is also configured and sized so as to be at least partially retained in said base channel by said frame side walls once inserted in said base channel.

4. A composite stud as recited in claim 1 wherein said core component is also configured and sized so as to be releasably and at least partially retained in said base channel by said frame side walls once inserted in said base channel so as to selectively allow axial withdrawal of said at least a portion of said core component from said base channel.

5. A composite stud as recited in claim 1 wherein said core component is configured and sized for allowing said core component to be at least partially inserted in said base channel from an insertion direction generally perpendicular relative to said frame longitudinal axis.

6. A composite stud as recited in claim 1 wherein at least one of said side wall first main edges is pivotally attached to a corresponding one of said base wall main peripheral edges so as to allow the corresponding frame side wall to pivot between a side wall first position and a side wall second position, wherein the pivotable frame side wall is in a generally perpendicular relationship relative to said frame base wall when the pivotable frame side wall is in said side wall first position and the pivotable frame side wall is in an outwardly angled relationship relative to said frame base wall when the pivotable frame side wall is in said side wall second position; whereby when the pivotable frame side wall is in said side wall first position it collaborates with the other frame side wall for locking at least a section of said core component in said base channel and when the pivotable frame side wall is in said side wall second position it facilitates the insertion of at least a section of said core component into said base channel along said insertion direction.

7. A composite stud as recited in claim 6 wherein said frame member is provided with a biasing means for biasing the pivotable frame side wall towards said side wall first position.

8. A composite stud as recited in claim 7 wherein said frame base wall and the pivotable frame side wall are made out of an integral and generally resilient piece of material, said at least one of said side wall first main edges being generally resiliently attached to a corresponding one of said base wall main peripheral edges.

9. A composite stud as recited in claim 1 wherein said frame member is made out of galvanized steel and said core component is made out of wood.

10. A composite stud as recited in claim 1 wherein said retaining means includes a retaining flange extending inwardly from said side wall inner surface adjacent said side wall second main edge of at least one of said frame side walls.

11. A composite stud as recited in claim 10 wherein said core first auxiliary wall is provided with a first retaining slot extending longitudinally at least partially therealong, said first retaining slot being configured and sized for receiving at least a section of one of said retaining flanges when said core component is inserted into said base channel.

12. A composite stud as recited in claim 11 wherein said first retaining slot extends generally transversely towards said core second auxiliary wall in a generally transversal slot plane, said slot plane generally dividing said core component into a core first cross-sectional area and a core second cross-sectional area.

13. A composite stud as recited in claim 12 wherein a section of said core first auxiliary wall located in said core first cross-sectional area is inwardly recessed relative to a section of said core first auxiliary wall located in said core second cross-sectional area.

14. A composite stud as recited in claim 12 wherein said first retaining slot defines a slot first wall located adjacent said core first cross-sectional area and a slot second wall located adjacent said core second cross-sectional area; said slot first wall extending at an angle relative to said slot plane, said slot first wall extending towards said slot second wall in a direction leading towards said core second auxiliary wall; whereby the configuration of said first retaining slot facilitates the insertion of at least a section of said core component into said base channel along said insertion direction.

15. A composite stud as recited in claim 11 wherein said core second auxiliary wall is provided with a second retaining slot extending longitudinally at least partially therealong, said second retaining slot being configured and sized for receiving at least a section of the other one of said retaining flanges when said core component is inserted into said base channel.

16. A composite stud as recited in claim 15 wherein said first and second retaining slots extend generally transversally towards each other in a generally transversal slot plane, said slot plane generally dividing said core component into a first core cross-sectional area and a second core cross-sectional area; wherein a section of said core first auxiliary wall located in said core first cross-sectional area is inwardly recessed relative to a section of said core first auxiliary wall located in said core second cross-sectional area and also wherein a section of said core second auxiliary wall located in said core first cross-sectional area is inwardly recessed relative to a section of said core second auxiliary wall located in said core second cross-sectional area.

17. A composite stud as recited in claim 16 wherein said first retaining slot defines a slot first wall located adjacent said core first cross-sectional area and a slot second wall located adjacent said core second cross-sectional area said slot first wall extending at an angle relative to said slot plane, said slot first wall extending towards said slot second wall in a direction leading towards said core second auxiliary wall; whereby the configuration of said first retaining slot facilitates the insertion of at least a section of said core component into said base channel along said insertion direction.

18. A composite stud as recited in claim 10 wherein said core component is provided with a pair of insertion recess sections, said insertion recess sections forming a fifth wall and a sixth wall of said core component respectively and extending generally at an angle respectively between said core first main wall and said core first and second auxiliary walls, respectively; wherein said insertion recess sections are configured and sized for facilitating the insertion of at least a section of said core component into said base channel along a direction generally perpendicular to said frame longitudinal axis.

19. A composite stud as recited in claim 1 wherein said retaining means includes a retaining flange extending inwardly from said side wall inner surface adjacent said side wall second main edge of both said frame side walls, said retaining flanges extending generally towards each other.

20. A composite stud as recited in claim 19 wherein said core component is also configured and sized so that said retaining flanges abuttingly contact said core second main wall when said core component is inserted into said base channel.

21. A composite stud as recited in claim 20 wherein said frame base wall defines a frame reinforcement recess, said core first main wall being provided with a generally complementarily-shaped corresponding core reinforcement recess for generally fittingly receiving said frame reinforcement recess when said core component is inserted into said base channel.

22. A composite stud as recited in claim 1 wherein said fifth wall has a generally flat configuration.

23. A composite stud as recited in claim 1 wherein said fifth wall has a generally arcuate configuration.

24. A composite stud comprising:

a generally elongated frame member, said frame member defining a frame longitudinal axis, a frame first longitudinal end and a generally opposed frame second longitudinal end; said frame member having a generally U-shaped cross-sectional configuration defining a frame base wall and a pair of frame side walls; said frame base wall defining a base wall inner surface, a base wall outer surface and a pair of opposed base wall main peripheral edges; each of said frame side walls defining a corresponding side wall inner surface, a side wall outer surface, a side wall first main edge and a generally opposed side wall second main edge; each of said side wall first main edges being attached to a corresponding one of said base wall main peripheral edges; said frame side walls being in a generally perpendicular relationship relative to said base wall and said side wall inner surfaces being in a generally facing relationship relative to each other so as to define a base channel therebetween;

a generally elongated core component; said core component defining a core longitudinal axis, a core first longitudinal end and an opposed core second longitudinal end; said core component being configured and sized to allow said core component to be at least partially inserted in said base channel from an insertion direction generally angled relative to said frame longitudinal axis in a snap-like manner;

retaining means positioned between said frame member and said core component for retaining at least a portion of said core component in said base channel once inserted thereinto;

at least one of said side wall first main edges being pivotally attached to a corresponding one of said base wall main peripheral edges so as to allow the corresponding frame side wall to pivot between a side wall first position and a side wall second position, wherein the pivotable frame side wall is in a generally perpendicular relationship relative to said frame base wall when the pivotable frame side wall is in said side wall first position and the pivotable frame side wall is in an outwardly angled relationship relative to said frame base wall when the pivotable frame side wall is in said side wall second position; whereby when the pivotable frame side wall is in said side wall first position it collaborates with the other frame side wall for locking at least a section of said core component in said base channel and when the pivotable frame side wall is in said side wall second position it facilitates the insertion of at least a section of said core component into said base channel along said insertion direction;

said retaining means including a retaining flange extending inwardly from said side wall inner surface adjacent said side wall second main edge of both said frame side walls, said retaining flanges extending generally towards each other;

said core component having a substantially rectangular cross-sectional configuration defining a core first main wall, a core second main wall, a core first auxiliary wall and a core second auxiliary wall; said core component being configured and sized so as to be insertable into said base channel with said core first main will positioned generally adjacent said base wall inner surface and said core first and second auxiliary walls positioned generally adjacent a corresponding one of said side wall inner surface; said core first auxiliary wall being provided with a first retaining slot extending longitudinally at least partially therealong, said first retaining slot being configured and sized for receiving at least a section of one of said retaining flanges when said core component is inserted into said base channel; said core second auxiliary wall being provided with a second retaining slot extending longitudinally at least partially therealong, said second retaining slot being configured and sized for receiving at least a section of the other one of said retaining flanges when said core component is inserted into said base channel;

said core component being provided with an insertion recess section, said insertion recess section forming a fifth wall of said core component and extending generally at an angle between said core first auxiliary wall and said core first main wall; wherein said insertion recess section is configured and sized for facilitating the insertion of at least a section of said core component into said base channel along said insertion direction in a snap-like manner.

25. A core component for use with generally elongated frame member so as to form a composite stud, said frame member defining a frame longitudinal axis, a frame first longitudinal end and a generally opposed frame second longitudinal end; said frame member having a generally U-shaped cross-sectional configuration defining a frame base wall and a pair of frame side walls; said frame base wall defining a base wall inner surface, a base wall outer surface and a pair of opposed base wall main peripheral edges; each of said frame side walls defining a corresponding side wall inner surface, a side wall outer surface, a side wall first main edge and a generally opposed side wall second main edge; each of said side wall first main edges being attached to a corresponding one of said base wall main peripheral edges; each of said side wall second main edges being provided with a corresponding retaining flange; said frame side walls being in a generally perpendicular relationship relative to said base wall and said side wall inner surfaces being in a generally facing relationship relative to each other so as to define a base channel therebetween; said core component comprising:

a core body, said core body defining a core longitudinal axis, a core first longitudinal end and an opposed core second longitudinal end; said core body having a substantially rectangular cross-sectional configuration defining a core first main wall, a core second main wall, a core first auxiliary wall and a core second auxiliary wall; said core body being configured and sized so as to be insertable into said base channel with said core first main wall positioned generally adjacent said base wall inner surface and said core first and second auxiliary walls positioned generally adjacent a corresponding one of said side wall inner surface; said core first auxiliary wall being provided with a first retaining slot extending longitudinally at least partially therealong, said first retaining slot being configured and sized for receiving at least a section of one of said retaining flanges when said core component is inserted into said base channel; said core second auxiliary wall being provided with a second retaining slot extending longitudinally at least partially therealong, said second retaining slot being configured and sized for receiving at least a section of the other one of said retaining flanges when said core component is inserted into said base channel;

said core component being provided with an insertion recess section, said insertion recess section forming a fifth wall of said core component and extending generally at an angle between said core first auxiliary wall and said core first main wall; wherein said insertion recess section is configured and sized for facilitating the insertion of at least a section of said core component into said base channel from an insertion direction generally angled relative to said frame longitudinal axis in a snap-like manner.

26. A core component as recited in claim 25 wherein said fifth wall extends generally at an angle between said core first auxiliary wall and said core first main wall.

27. A core component as recited in claim 25 wherein said core first main wall is short relative to said core second main wall and wherein said second retaining slot is a recessed section, said fifth wall being generally arcuate and extending between said core first auxiliary wall and said short core first main wall.

28. A core component as recited in claim 25 further including an attachment board secured to said core body, said attachment board extending generally outwardly and transversely from said core second main wall along said core second auxiliary wall from a position adjacent said second retaining slot.

* * * * *